US006115566A

United States Patent [19]

Ohara et al.

[11] Patent Number: 6,115,566

[45] Date of Patent: Sep. 5, 2000

[54] SEAL MEMBER FOR IMPEDING LEAKAGE OF TONER IN A PRINTING APPARATUS

[75] Inventors: Yasuyuki Ohara; Toyohiro Kanzaki; Masaru Nakayama, all of Chiryu, Japan

[73] Assignee: Tsuchiya Tsco Co., Ltd., Aichi-ken, Japan

[21] Appl. No.: 09/138,469

[22] Filed: Aug. 14, 1998

[30] Foreign Application Priority Data

Aug. 20, 1997 [JP] Japan ..... 9-223826

[51] Int. Cl.[7] ..... G03G 15/08

[52] U.S. Cl. ..... 399/103; 399/105

[58] Field of Search ..... 399/102, 103–106, 399/287

[56] References Cited

U.S. PATENT DOCUMENTS 5,488,462 1/1996 Ishikawa et al. ..... 399/102

FOREIGN PATENT DOCUMENTS

| | | |
|---|---|---|
| 4-159563 | 6/1992 | Japan . |
| 4-234779 | 8/1992 | Japan . |
| 4-367882 | 12/1992 | Japan . |
| 5-40402 | 2/1993 | Japan . |
| 5-181353 | 7/1993 | Japan . |
| 7-160168 | 6/1995 | Japan . |
| 7-334056 | 12/1995 | Japan . |
| 10-309760 | 11/1998 | Japan . |
| 1-214680 | 3/1999 | Japan . |

*Primary Examiner*—Quana Grainger
*Attorney, Agent, or Firm*—Sheridan Ross P.C.

[57] ABSTRACT

A seal member seals a housing that accommodates fine particles used for printing images and a movable member for feeding the particles to a printing mechanism. The seal member resists leakage of the particles from between the housing and the movable member. The seal member includes fibers for capturing the particles and a support layer for supporting the fibers, wherein the fibers are inclined relative to the support layer at a predetermined angle.

17 Claims, 9 Drawing Sheets

SEAL MEMBER FOR IMPEDING LEAKAGE OF TONER IN A PRINTING APPARATUS

BACKGROUND OF THE INVENTION

The present invention relates to a seal member for impeding leakage of fine particles. More particularly, the present invention relates to a seal member for impeding leakage of toner in a printing apparatus such as a copier, a printer or a fax machine.

Printing apparatuses using toner are less costly to operate in comparison to other printing apparatuses such as thermal printing apparatuses. As a result, toner-based printing apparatuses have been widely accepted for both business and personal use.

Typically, toner-based printing apparatuses include a developer. The developer has a housing in which the toner and a cylindrical developer roller are accommodated. In an interior of the housing, the toner first adheres to the surface of the developer roller and is then transferred from the developer roller to the outer circumferential surface of a drum coated with photosensitive material, as the roller rotates. The toner is then electrically attracted to a latent image formed on the outer surface of the drum after exposure by a light beam from an exposure unit. This produces a reversed image, made of the toner, on the photosensitive material. The reversed image is then transferred to paper by a transfer unit and is fused to the paper to produce a print.

In the interior of the developer, a cylindrical space or clearance in which the toner is accommodated is defined between the developer roller and the inner circumferential surface of the housing. Seal members are attached to both ends of the housing to engage the respective ends of the roller. The seal members seal the clearance to impede leakage of the toner from the housing.

Prior art seal members have an engaging layer for slidably engaging with the respective ends of the roller and a support layer located under the engaging layer and attached to the inner surface of the housing. The engaging layer includes felt made of fluororesin fibers. The support layer includes laminated sponge layers.

Since the engaging layer of the prior art seal member is made from felt, the engaging layer has a relatively low durability, so that if the engaging layer is used for a long period of time, many fibers are depilated from the engaging layer or deformed. Because of this disadvantage, the effectiveness of the seal member gradually deteriorates, and the toner may leak from the developer.

Furthermore, while the prior art seal member is attached to the inner surface of the housing, wrinkles may be formed in the seal member. This may result in a space, from which toner may leak, forming between an adhesive surface of the seal member and the inner surface of the housing.

SUMMARY OF THE INVENTION

An objective of the present invention is to provide a seal member capable of impeding the leakage of fine particles such as toner for a long period of time.

In order to achieve the above objective, the seal member of the present invention is arranged in a housing that accommodates fine particles used for printing images and a movable member for feeding the particles to a printing mechanism. The seal member impedes leakage of the particles from a clearance between the housing and the movable member. The seal member includes fibers for capturing the particles and a support layer for supporting the fibers. The fibers are inclined relative to the support layer at a predetermined angle.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objectives and advantages thereof, may best be understood by reference to the following description of the present preferred embodiments together with the accompanying drawings in which:

DETAILED DESCRIPTION OF THE PREFERRED EMBODIMENTS

Figure 5:
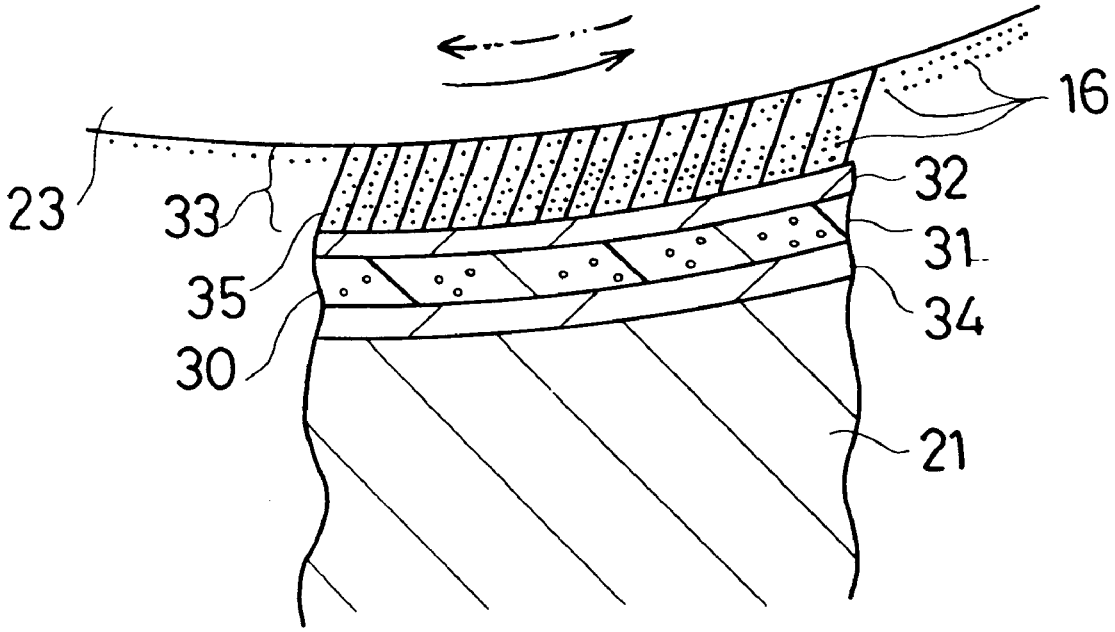
FIG. 5 is an enlarged partial cross sectional view showing the seal member capturing the toner.
Figure 6:
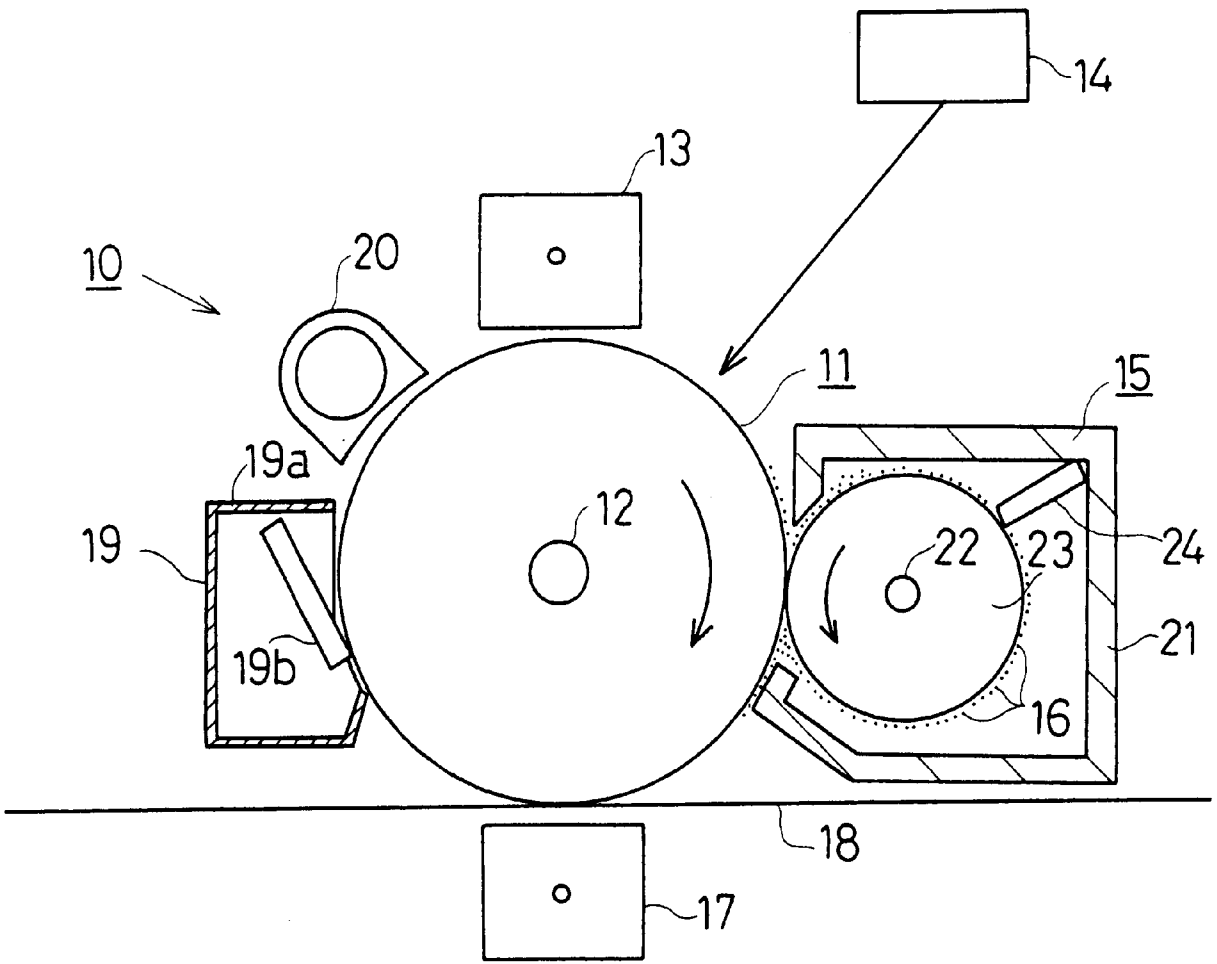
FIG. 6 is a schematic cross sectional view showing the parts of a color laser printer.

A first embodiment of the present invention will be described with reference to FIGS. 1 to 6. FIG. 6 shows the main parts of a color laser printer 10. A drum 11 is rotatably supported by a support shaft 12. A photosensitive material is coated on the outer circumferential surface of the drum 11. A charger 13 extends parallel to the axis of the drum 11 and is spaced from the outer surface of the drum 11. The charger 13 develops electrical charge, more particularly, positive charge, on the outer surface of the drum 11 facing the charger 13. An exposure unit 14 is positioned clockwise from the charger 13 with respect to the drum 11. The exposure unit 14 projects a laser beam corresponding to an image of a final print on the drum 11. A corresponding area exposed to the laser beam forms a latent image since the charge in this area is removed when exposed to the laser beam. The latent image is then developed by a developer 15.

The developer 15 extends parallel to the axis of the drum 11 and is positioned clockwise from the exposure unit 14 with respect to the drum 11. The developer 15 supplies the toner 16 to the outer surface of the drum 11. The toner 16 is electrically attracted to the latent image. As a result, a reversed image is formed by the toner 16 on the outer surface of the drum 11.

The transfer unit 17 is positioned clockwise from the developer 15. The transfer unit 17 transfers the reversed image formed on the outer surface of the drum 11 to a sheet of recording paper 18 guided between the transfer unit 17 and the drum 11.

A remover 19 is positioned clockwise from the transfer unit 17. The remover 19 has a housing 19*a* in which a blade 19*b* is held. The blade 19*b* removes excess toner 16 from the surface of the drum 11.

An eraser 20 is positioned clockwise from the remover 19. The eraser 20 erases any remaining electric charge from the outer surface of the drum 11.

Printing mechanisms like that described above are placed at several points along a path of the recording paper 18 within the color printer 10, and each mechanism corresponds to a different color. A color image is printed on the recording paper 18 through a combination of colors provided by the respective printing mechanisms.

The developer 15 has a housing 21 in which the toner 16 and a developer roller 23 are accommodated. The roller 23 is rotatably supported by a support shaft 22. In the interior of the housing 21, a blade 24 is arranged in a certain position with respect to the roller 23, as shown in FIG. 6. The blade 24 removes excessive toner 16 from the surface of the roller 23. The toner 16 is transferred from the roller 23 to the outer surface of the drum 11 through rotation of the roller 23. The toner 16 is transferred to the surface of the drum 11 as the roller 23 contacts the drum 11.

Figure 3:
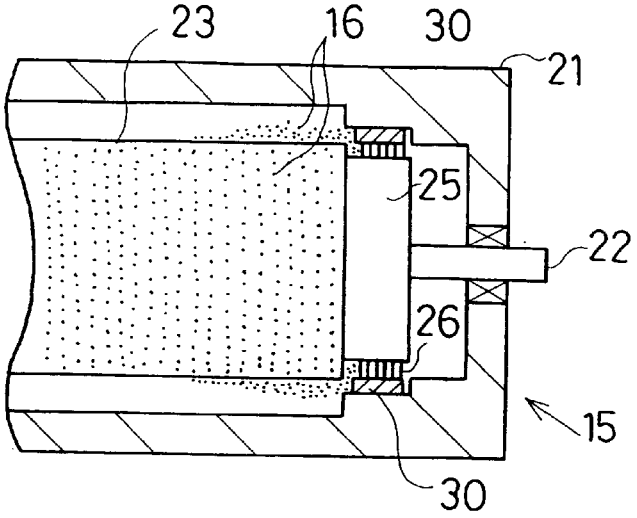
FIG. 3 is a partial schematic sectional view showing one end of a developer provided with the seal member of the first embodiment.
Figure 4:
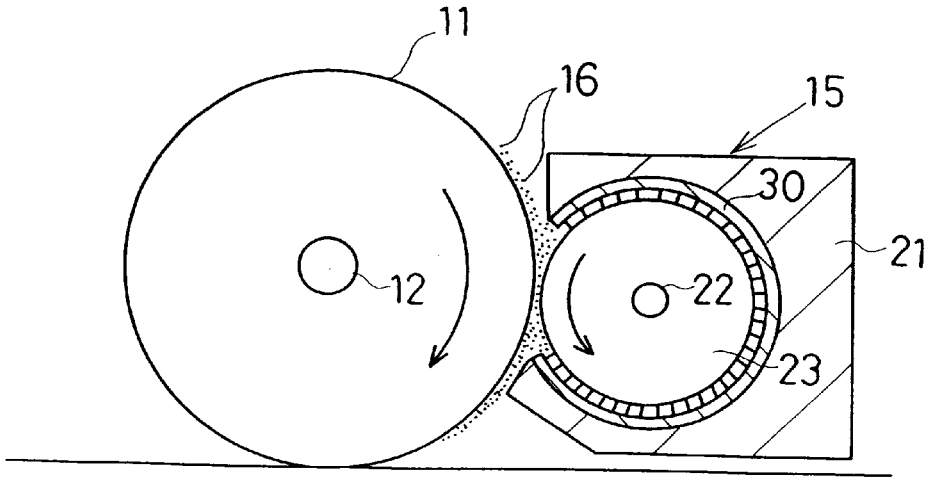
FIG. 4 is a schematic cross sectional view showing toner and developer roller.

As shown in FIG. 3, the outer circumferential surface of the roller 23 is spaced from the inner circumferential surface of the housing 21. A cylindrical space, or clearance 26, is defined between the outer circumferential surface of a small diameter portion 25 formed at each end of the roller 23 and a corresponding inner surface of the housing 21. The clearance 26 according to this embodiment is about 2 mm. The seal member 30 is adhered to the inner surface of the housing 21 and faces the small diameter portion 25 to seal the clearance 26.

Figure 1:
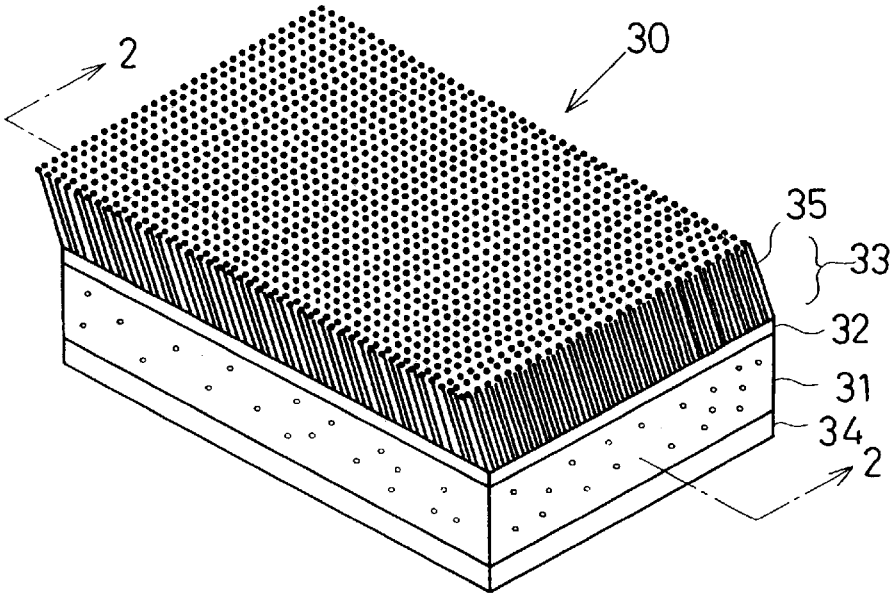
FIG. 1 is a perspective view of a section of seal member in accordance with a first embodiment of the present invention.
Figure 2:
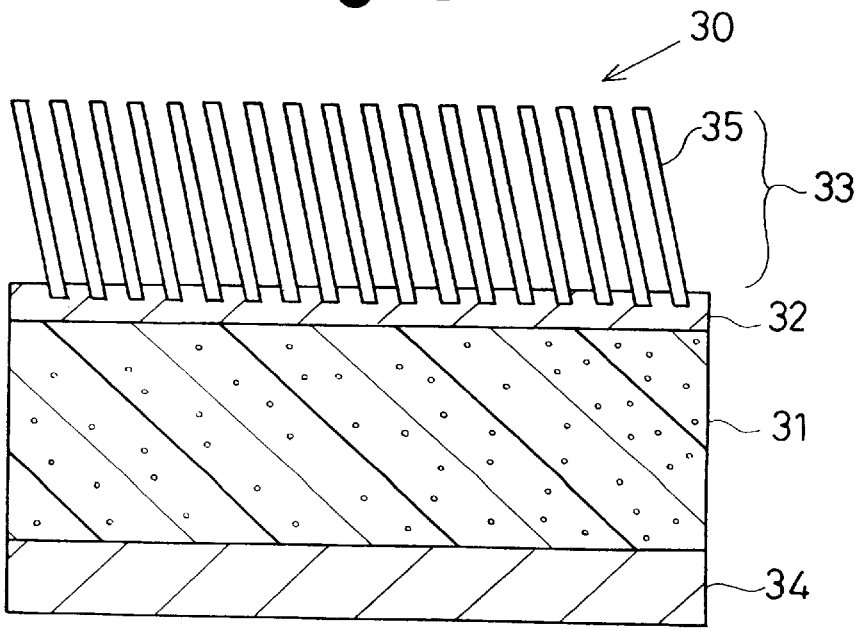
FIG. 2 is an enlarged partial sectional view taken along line 2—2 in FIG. 1.

As shown in FIGS. 1 and 2, the seal member 30 includes a support layer 31, a first adhesive layer 32 placed on a top surface of the support layer 31, an engaging layer 33 having fibers 35 implanted in the first adhesive layer 32, and a flexible second adhesive layer 34 adhered to a backside of the support layer 31. The thickness of the seal member 30 before it is installed is about 3 mm. The support layer 31 has compressive elasticity in the direction of its thickness so that the support layer 31 can be elastically deformed when compressed in a direction perpendicular to the plane of the support layer 31. As a result, when the seal member 30 is installed on the inner surface of the housing 21, the seal member 30 closely engages the outer surface of the roller 23 and is compressed to a thickness of about 2 mm.

Preferably, the material of the support layer 31 is durable and heat resistant and can be adhered by an adhesive. Examples of such material include synthetic resin foam such as polyurethane, polystyrene or polypropylene, synthetic rubbers such as ethylene propylene dien monomer (EPDM) or chloroprene rubber, and thermoplastic elastomer such as natural rubber, olefinic elastomer or styrenic thermoplastic elastomer. The support layer 31 in accordance with this embodiment is formed of flame-retardant polyurethane foam (PORON U-32 with a thickness of 1.5 mm manufactured by Rogers INOAC Corporation). The polyurethane foam may be selected from a group consisting polyester polyurethane and polyether polyurethane.

The engaging layer 33 includes fibers 35 having equal thickness and length. The fibers 35 are implanted in the first adhesive layer 32, which is placed on the support layer 31. The fibers 35 have a low coefficient of friction, high durability and heat resistance. Examples of materials forming the fibers include ultra high molecular weight polyethylene, polypropylene, polyamide, aramid resin and fluororesin. Fluororesin is particularly preferred since it has a low coefficient of friction. Polypropylene is also preferred since it has an adequate flexural rigidity and is easily charged by friction (for attracting toner).

The fluororesin may be polytetrafluoroethylene (PTFE), tetrafluoroethylene-perfluoroalkyl vinyl ether copolymer (PFA), Ethylene-tetrafluoroethylene copolymer (ETFE) or polyvinylidene fluoride (PVDF). PTFE is easily purchased and is normally the preferred fluororesin of the fibers 35. The thickness and length of the fibers 35 are selected to permit the fibers 35 to flex. PTFE fibers named TOYOFLON (trademark), 2400 deniers/180 filaments manufactured by Toray Industries, Inc., have been successfully employed.

As shown in FIG. 2, the fibers 35 are implanted in the first adhesive layer 32, which is placed on the support layer 31. This implantation is carried out by a process of electrostatic flocking. The electrostatic flocking is a process in which the fibers 35 are erected by static electricity and then adhered to the first adhesive layer 32.

The fibers 35 are densely and regularly arranged on the support layer 31. The fibers 35 are inclined to extend in the same direction (if the seal member 30 is flat as shown in FIG. 1). Each fiber 35 is inclined toward a rotating direction of the roller 23 (indicated by the solid line arrow in FIG. 5). The angle of the inclination of each fiber 35 toward the rotating direction of the roller 23 relative to a radius of the roller 23 that intersects the base of the fiber 35 is about 5 to 70 degrees. The fibers 35 having this construction strongly resist leakage of the toner 16 in the axial direction of the roller 23 beyond the small diameter portion 25 of the roller 23. The fibers 35 do not significantly resist the rotation of the roller 23 since the fibers 35 are inclined toward the rotating direction.

The first adhesive layer 32 preferably has adequate flexibility and heat resistance even after solidification. A rubber adhesive or an acrylic adhesive is used for the first adhesive layer 32. The first adhesive layer 32 of this embodiment includes an acrylic adhesive commonly used in electrostatic flocking.

The second adhesive layer 34 is placed on the backside of the support layer 31. The second adhesive layer 34 adheres the seal member 30 to the inner surface of the housing 21. The second adhesive layer 34 preferably includes an adhesive that is heat resistant and flexible after solidification. A rubber or acrylic pressure sensitive adhesive has above described characteristics. An acrylic pressure sensitive adhesive, F-9469PC, VHB adhesive transfer tape with 0.125 mm thickness manufactured by Sumitomo 3 M limited, is preferred.

Operation of the seal member 30 will now be described.

As shown in FIG. 6, in the printing process of the color printer 10, the outer surface of the rotating drum 11 is uniformly charged by the charger 13. Then, a laser beam corresponding to an image of an original is projected on the outer surface of the drum 11 to form a latent image on the outer surface of the drum 11. The latent image is developed by supplying the toner 16 to the outer surface of the drum 11 via the roller 23 in the developer 15. The transfer unit 17 transfers the developed visible image formed by the toner 16 from the drum 11 to a sheet of recording paper 18 fed between the drum 11 and the transfer unit 17.

After the image is transferred to the paper, excess toner 16 remaining on the outer surface of the drum 11 is removed by the cleaning blade 19*b*. Then, the remaining electrical charge on the surface of the drum 11 is erased by the eraser 20.

In the developing process, the roller 23 rotates around the support shaft 22 in the developer 15. The toner 16, which is deposited in the bottom of the developer 15, is supplied to the drum 11 via the roller 23. At this time, the toner 16 has a tendency to leak from the small diameter portions 25 of the roller 23 to outside of the housing 21. Since the fibers 35 of the engaging layer 33 are inclined toward the rotating direction of the roller 23, relative to a radius of the roller 23, the toner 16 tending to leak out is captured by the fibers 35. As a result, leakage of the toner 16 is impeded and substantially prevented by the seal member 30.

The support layer 31 is manufactured from a material having both flexibility and elasticity. Because of these characteristics, the engaging layer 33 may be pressed against the outer surface of the roller 23, so that tips of the fibers 35 are engaged with the outer surface of the roller 23 without forming a space between the tips of the fibers 35 and the outer surface of the roller 23. Since the fibers 35 are made of the low friction fibers and are inclined toward the rotating direction of the roller 23, the fibers 35 do not significantly resist the rotation of the roller 23. The fibers 35 self-restore their original state even if the fibers 35 are greatly inclined toward the rotating direction of the roller 23 because of the flexibility and restorability of the fibers 35. Therefore, the sealing performance of the seal member 30 is maintained over a long period of use.

In addition to the support layer 31, the second adhesive layer 34 and the first adhesive layer 32 are also flexible, so the entire seal member 30 is flexible. Therefore, the seal member 30 will not form wrinkles when it is adhered to the inner surfaces of the housing 21. As a result, a space will not be formed between the second adhesive layer 34 and the inner surface of the housing 21, thus leakage of the toner 16 is effectively prevented.

Advantages of the seal member 30 of FIGS. 1 to 6 are as follows:

The support layer 31 is compressed while it is in use. Therefore, the engaging layer 33 is always pressed against the outer surface of the roller 23, and the fibers 35 always engage with the outer surface of the roller 23. As a result, the seal member 30 effectively impedes and prevents leakage of the toner 16.

The fibers 35 are made from material having a low coefficient of friction and high durability. Therefore, the seal member 30 reliably prevents leakage of the toner 16 over an extended period of time.

The fibers 35 are implanted in the first adhesive layer 32, which is placed on the support layer 31, so that the seal member 30 can be easily manufactured at a low cost.

The fibers 35 are inclined toward the rotating direction of the roller 23 at a predetermined angle relative to a radius of the roller 23 that intersects the base of the fibers, so that leakage of the toner 16 is effectively prevented.

The first adhesive layer 32 and the second adhesive layer 34 are flexible even after solidification so that the seal member 30 is tightly adhered to the inner surface of the housing 21. As a result, the seal member 30 effectively resists leakage of the toner 16.

The fibers 35 are flexible and self-restore their shape. With this characteristic, engagement of the tips of the fibers 35 with the outer surface of the roller 23 is always maintained. As a result, the seal member 30 effectively resists leakage of the toner 16.

A second embodiment of the present invention will be described in reference to FIG. 7, focusing on differences between the first embodiment and the second embodiment.

Figure 7:
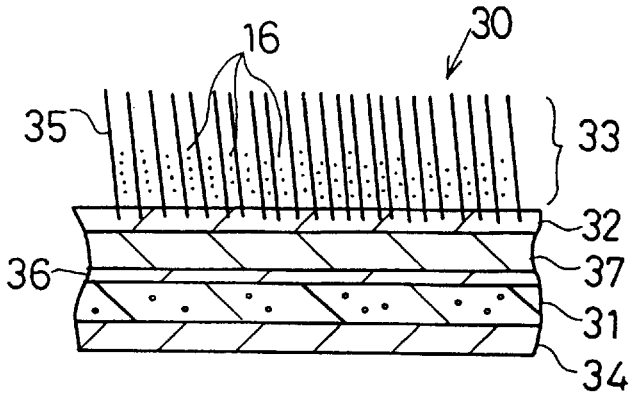
FIG. 7 is a partial enlarged cross sectional view showing a seal member according to a second embodiment.

As shown in FIG. 7, a substrate 37 of the seal member 30 is adhered to the inner surface of the support layer 31 with a third adhesive layer 36 coated on the support layer 31. The substrate 37 may be a heat resistant cloth or film, which is adhered to the support layer 31 by the adhesive 36. The cloth or film may be made of, for example, cotton, polyester, polypropylene, acrylic resin, nylon or urethane resin. In the embodiment of FIG. 7, polyester film is preferably used as the substrate 37. The first adhesive layer 32 is provided on the inner surface of the substrate 37. Fibers 35, like those in the first embodiment, which are made of fluororesin are implanted in the first adhesive layer 32. In this embodiment, the substrate 37 and the support layer 31 constitute a support. Furthermore, the support layer 31 can be eliminated. Therefore, the support can be constituted solely of the substrate 37 or of the support layer 31. Alternatively, the support can be constituted of both the substrate 37 and the support layer 31.

The support layer 31 has the second adhesive layer 34 on its outer surface. The engaging layer 33 is formed in such that the fibers 35 are first attached to the inner surface of the substrate 37 with the first adhesive layer 32 and then inclined in one direction. The substrate 37, which is adhered to the engaging layer 33, is adhered to the support layer 31 with the third adhesive layer 36. The seal member 30 of FIG. 7 is adhered to the inner surface of the housing 21 with the second adhesive layer 34.

The fibers 35 of the second embodiment have the same advantages as those of the first embodiment, since the fibers 35 of FIG. 7 are inclined in one direction like those of the first embodiment. The substrate 37 holds the fibers 35 more firmly. The engaging layer 33 and the support layer 31 of the seal member 30 are manufactured separately. That is, the engaging layer 33 and the support layer 31 are independently manufactured and then combined to form the seal member 30. Therefore, in the first embodiment, if the material of the support layer 31 needs to be replaced, the engaging layer 33 must be newly formed on the top surface of the replaced support layer 31. However, in the second embodiment, the engaging layer 33 and the support layer 31 are separately formed, so that the existing substrate 37 can be adhered to the top surface of the replaced support layer 31 with the third adhesive layer 36, requiring no modification of the manufacturing process.

In the seal member 30 of the second embodiment, the fibers 35 are attached to the top surface of the substrate 37. The substrate 37 is, in turn, adhered to the support layer 31 with the third adhesive layer 36. With this construction, even though the number of parts are greater than that of the first embodiment, the depilation of the fibers 35 is reduced since the fibers 35 are more firmly attached to the substrate 37. As a result, leakage of the toner 16 is resisted for an even longer period of time.

A third embodiment of the present invention will now be described in reference to FIG. 8, focusing on differences between the third embodiment and previously described embodiments.

The support layer 31 of the seal member 30 is made from a heat shrinkable material. Polystyrene resin and polyethylene resin are examples of suitable heat shrinkable materials.

Figure 8:
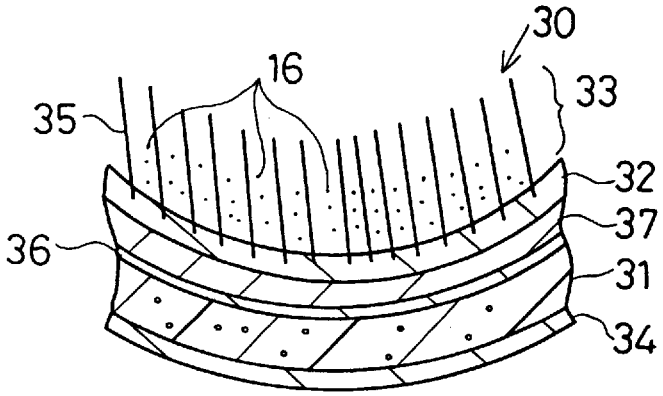
FIG. 8 is a partial enlarged cross sectional view showing a seal member according to a third embodiment.

If the top surface of the seal member 30 is heated for a predetermined time at a predetermined temperature, the inner surface of the support layer 31 is shrunk so that the seal member 30 is deformed as shown in FIG. 8. By adjusting the degree of this deformation, the contour of the seal member 30 can be adapted to the shape of the inner surface of the housing 21. If the deformed seal member 30 is attached to the inner surface of the housing 21, the space between the inner surface of the housing 21 and the second adhesive layer 34 is effectively sealed. Therefore, leakage of the toner from the space between the housing 21 and the second adhesive layer 34 is effectively resisted. Also, since the engaging layer 33 is manufactured separately, the support layer 31 of the second embodiment (FIG. 7) can be easily replaced with the heat shrinkable support layer 31.

A fourth embodiment of the present invention will be described in reference to FIG. 9, focusing on differences between the fourth embodiment and the previously described embodiments.

Figure 9:
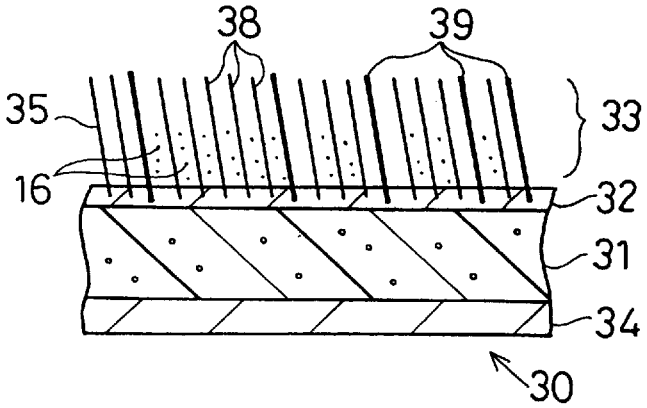
FIG. 9 is a partial enlarged cross sectional view showing a seal member according to a fourth embodiment.

As shown in FIG. 9, the engaging layer 33 of the seal member 30 has two types of fluororesin fibers, which have different thicknesses, i.e., thin fibers 38 and thick fibers 39. The two types of fibers 38 and 39 are irregularly mixed and implanted to form the engaging layer 33. The thickness of each thick fiber 39 is about 2 to 10 times greater than that of the thin fibers 38.

The inclination of the fibers 35 is retained by the thick fibers 39. That is, the thin fibers 38 are supported by the thick fibers 39. The thick fibers 39 prevent the group of fibers 35 from permanently deforming from their normal state when they are deformed by the rotation of the roller 23, so that the original inclination of the entire fibers 35 is retained. With this construction, toner particles 16 that are carried to the base of the fibers 35 do not escape from the inner side of the seal member 30, or the distal ends of the fibers 35. The seal member 30 thus resists leakage of the toner 16 more effectively.

A fifth embodiment of the present invention will now be described in reference to FIG. 10, focusing on differences between the fifth embodiment and the previously described embodiments.

Figure 10:
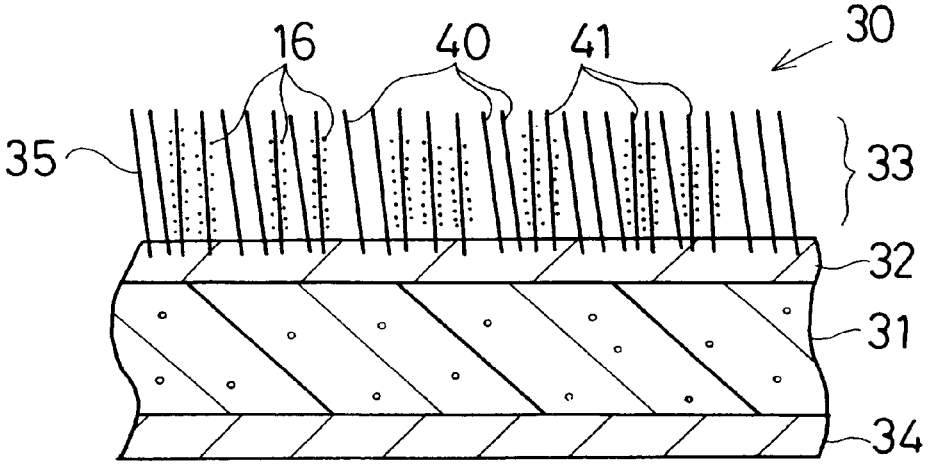
FIG. 10 is a partial enlarged cross sectional view showing a seal member according to a fifth embodiment.

The seal member 30 of FIG. 10 is different from that of the first embodiment and includes both low-friction fibers 40 and attractive fibers 41, which are capable of strongly attracting the toner 16. The two types of the fibers 40 and 41 are irregularly mixed and attached to the support layer 31. The ratio of two types of fibers 40 and 41 is determined in accordance with the intended use of the seal member 30. The low-friction fibers 40 of this embodiment are made from fluororesin like in the first embodiment. The attractive fibers 41 are special fibers having positively charged surfaces. Therefore, the attractive fibers 41 will tend to attract the negatively charged toner particles 16.

Since the engaging layer 33 has low-friction fibers 40, the engaging layer 33 will not significantly resist the rotation of the roller 23.

A sixth embodiment of the present invention will be described in reference to FIG. 11, focusing on differences between the sixth embodiment and the previously described embodiments.

Figure 11:
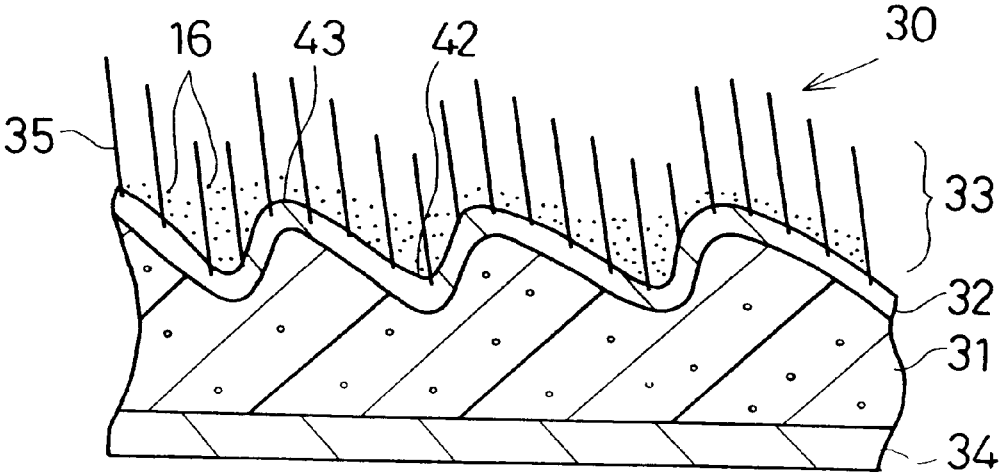
FIG. 11 is a partial enlarged cross sectional view showing a seal member according to a sixth embodiment.

As shown in FIG. 11, the support layer 31 of the seal member 30 has alternating, continuous troughs 42 and ridges 43, which have a predetermined shape. Each ridge 43 and trough 42 extends in the axial direction of the roller. Thus, the horizontal direction of FIG. 11 corresponds to the circumferential direction of the small diameter portion 25.

Like in the first embodiment, the fluororesin fibers 35 are attached to the inner surface of the support layer 31 with the first adhesive layer 32. The engaging layer 33 has fibers 35 of substantially equal length. Therefore, the inner contour of the engaging layer 33, which is defined by the tips of fibers 35, follows the contours of the troughs 42 and the ridges 43 of the support layer 31. The toner 16, which is captured by the fibers 35 arranged on the ridges 43, is carried to the bases of the fibers 35 located in the troughs 42 and is retained there. Therefore, the seal member 30 easily and effectively resists leakage of the toner 16.

A seventh embodiment of the present invention will be described with reference to FIGS. 12 and 13, focusing on differences between the seventh embodiment and the second embodiment.

Figure 12:
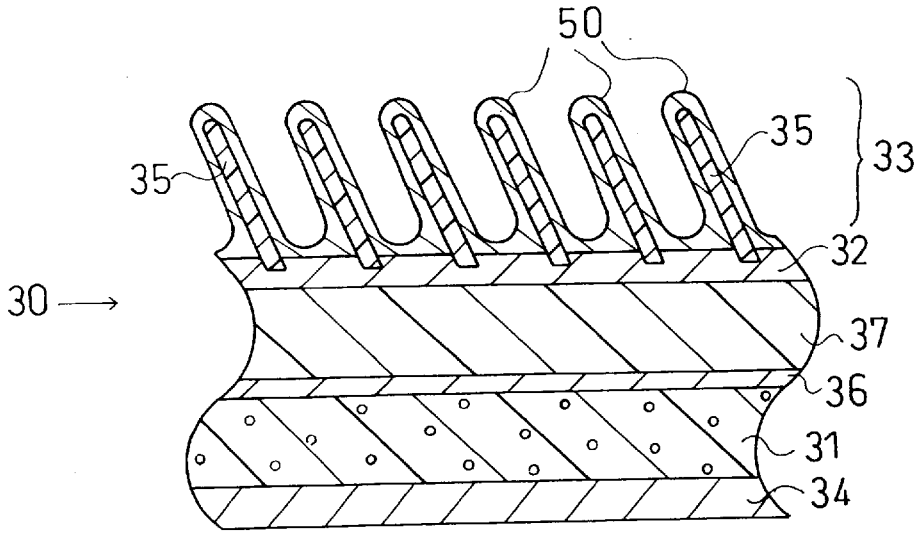
FIG. 12 is a partial enlarged cross sectional view showing a seal member according to a seventh embodiment.
Figure 13:
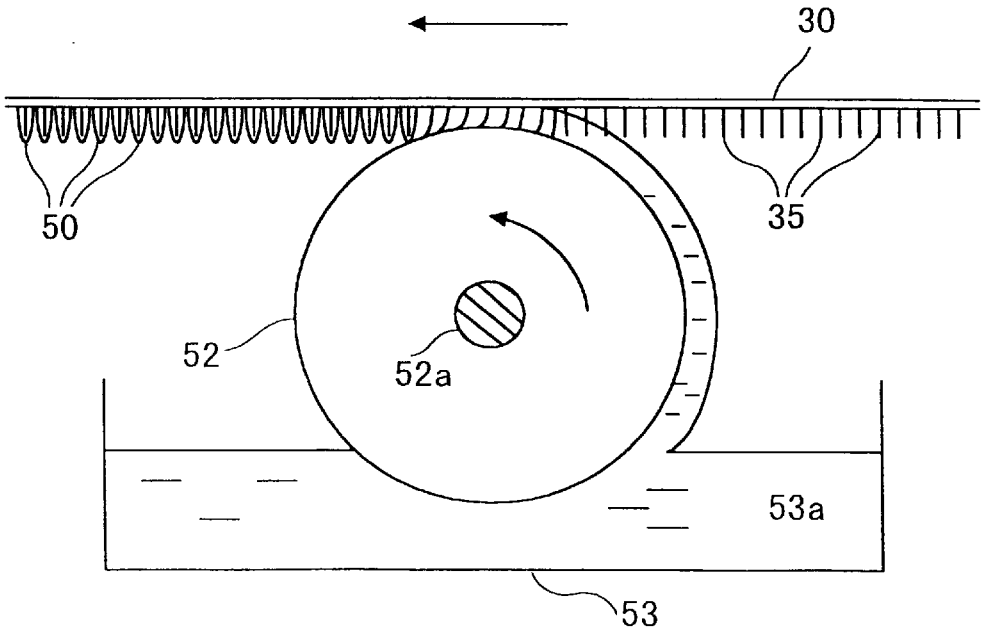
FIG. 13 is a schematic cross sectional view showing a device used in a roll coating process.

As shown in FIG. 12, the fibers 35 of the seal member 30 are low-friction fibers. Natural fibers such as cotton, rayon fibers, regenerated fibers such as cupra, semi synthetic fibers such as cellulose acetate fibers and synthetic fibers such as acrylic, polypropylene, polyamide, polyester or polyurethane may be used. Each fiber 35 has a coating layer 50 on its outer surface. The layer 50 is a substance for reducing the coefficient of friction. Furthermore, a woven fabric is used as the substrate 37.

Fluororesin or silicone may serve as the substance for reducing the coefficient of friction. In the embodiment of FIG. 12, the fluororesin is used as the substance for reducing the coefficient of friction.

The fibers 35 may be colored to provide contrast with the toner 16. This permits rapid visual checking of the seal to determine its effectiveness. Therefore, fibers that can be easily surface treated and colored are required. In the embodiment of FIG. 12, flesh colored rayon fibers having characteristics of adequate hygroscopicity, a low coefficient of friction and a low cost are used.

The coating layer 50 may be formed, for example, by roll coating or spraying.

The roll coating may be conducted as follows. As shown 53*a* in FIG. 13, a chemical tank 53 contains the coating substance 53*a*. The roller 52 is rotatably supported by a driving shaft 52*a*. A lower part of the roller 52 is dipped in the substance 53*a*. As the roller 52 is rotated, the substance 53*a* adheres to the outer circumferential surface of the roller 52. The fibers 35 of the seal member 30 arranged above the roller 52 are positioned to engage with the roller 52. The seal member 30 may move in a horizontal direction as the roller 52 rotates.

When the roller 52 rotates counterclockwise (the direction shown by the arrow in FIG. 13), the substance 53*a* adhering to the outer surface of the roller 52 is transferred to the outer surface of the fibers 35. The fibers 35 engaging with the roller 52 are coated with the substance 53*a*. The coating layer 50 is thus formed on the outer surface of each fiber 35.

The substance 53*a* may also be sprayed on the fibers 35 before or after their implantation. In a preferred process, the surfaces of the fibers 35 are sprayed with pulverized fluororesin (SCOTCHGARD manufactured by Sumitomo 3 M limited) after the implantation of the fibers 35.

The woven fabric constituting the substrate 37 is woven from warp and weft made of low-friction fibers. The warp and weft are preferably made of filament yarns that produce smooth fabric surfaces for reducing friction. Since the first adhesive layer 32 is coated on the surface of the substrate 37 before the fibers 35 are attached to the substrate 37, the warp and weft preferably have good hygroscopicity to enhance adhesiveness of the substrate 37. Furthermore, the warp and weft are preferably made from the same material as that of the fibers 35 for achieving a high productivity. In the embodiment of FIG. 12, rayon fibers (the warp thickness being 300 deniers, and the weft thickness being 450 deniers) form the woven fabric of the substrate 37.

The woven fabric of the substrate 37 may be, for example, twill weave, sateen weave or plain weave. The preferred woven fabric of the substrate 37 of FIG. 12 is a twill weave with smooth surfaces to enhance the adhesiveness of the woven fabric. The preferred twill weave has 76 warp threads/inch and 50 weft threads/inch.

Each fiber 35 attached to the substrate 37 by the first adhesive layer 32 preferably has a thickness of 0.5 to 10 deniers. If the thickness of the fiber 35 is less than 0.5 deniers, the toner attracting performance of the fiber 35 greatly deteriorates. If the thickness of the fiber 35 is greater than 10 deniers, the flexibility of the fiber 35 is reduced and the resistance to the rotation of the roller is greatly increased.

Furthermore, each fiber 35 preferably has a length of 0.5 to 5 mm. If the length of the fiber 35 is less than 0.5 mm, the toner attracting performance of the fiber 35 is greatly reduced. If the length of the fiber 35 is greater than 5 mm, the fiber can not be easily processed so that productivity is greatly reduced, and the restorability of the fiber 35 is also greatly reduced.

Rayon fibers 35 that are 2 deniers thick and 1.2 mm long are preferred. Also, acrylic adhesive including acrylate is used for the first adhesive layer 32 of FIG. 12.

In the manufacturing process of the seal member 30 in accordance with the seventh embodiment, the fibers 35 are attached to the surface of the substrate 37 with the first adhesive layer 32 to form the engaging layer 33. Fluororesin coating is then sprayed on the fibers 35 to form the coating layer 50. The fibers 35 are then inclined as in the first embodiment. Thereafter, the substrate 37, which has the engaging layer 33 on it, is adhered to the surface of the support layer 31 with the third adhesive layer 36. The second adhesive layer 34 is placed on the backside of the support layer 31. The seal member 30 is then adhered to the inner surface of the housing 21 as in the first embodiment.

The fibers 35 of FIG. 12 are coated to reduce the coefficient of friction, so that the fibers 35 have a low coefficient of friction like the fibers in the second embodiment of FIG. 7. Also, the thickness and the length of the fibers 35 are selected to provide good sealing characteristics, and the fibers 35 and the substrate 37 are formed from the same material. Therefore, the productivity of the manufacturing process is increased. Furthermore, since the substrate 37 is made of woven fabric, the seal member 30 is flexible. Also, by appropriately selecting the thicknesses of the warp and the weft and the weave type, the adhesiveness between the substrate 37 and the support layer 31 and between the substrate 37 and the fibers 35 is improved.

In the seal member 30 of the seventh embodiment, each fiber 35 is coated with a coating 50 for reducing the coefficient of friction. Therefore, the seal member 30 will not significantly resist the rotation of the roller 23, regardless of the material constituting the fibers 35.

Rayon, as a preferred fiber material, is relatively inexpensive, so the manufacturing cost of the seal member 30 is relatively low.

The preferred rayon fibers 35 of FIG. 12 are easily dyed with a desired color.

The fibers 35 constituting the engaging layer 33 and the substrate 37 are made from the same material, so the engaging layer 33 and the substrate 37 are strongly adhered to one another.

An eighth embodiment of the present invention will be described in reference to FIGS. 14 and 15, focusing on differences between the eighth embodiment and the seventh embodiment.

Figure 14:
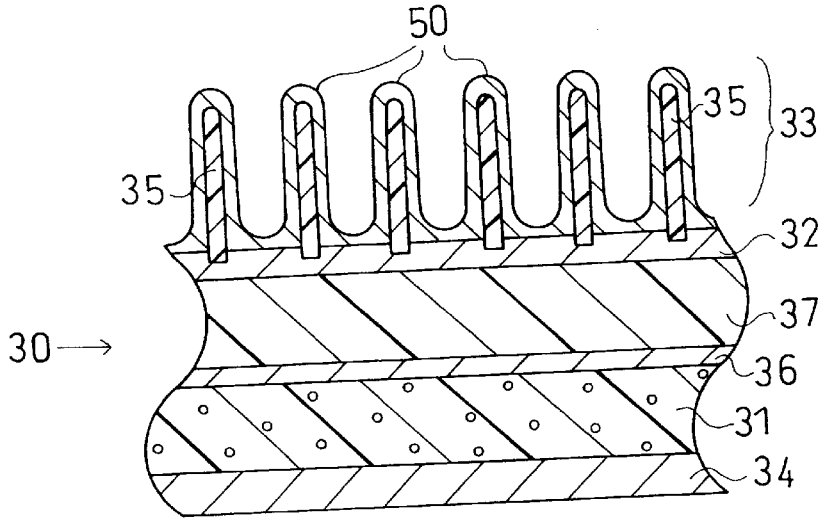
FIG. 14 is a partial cross sectional view showing a seal member according to an eighth embodiment.
Figure 15:
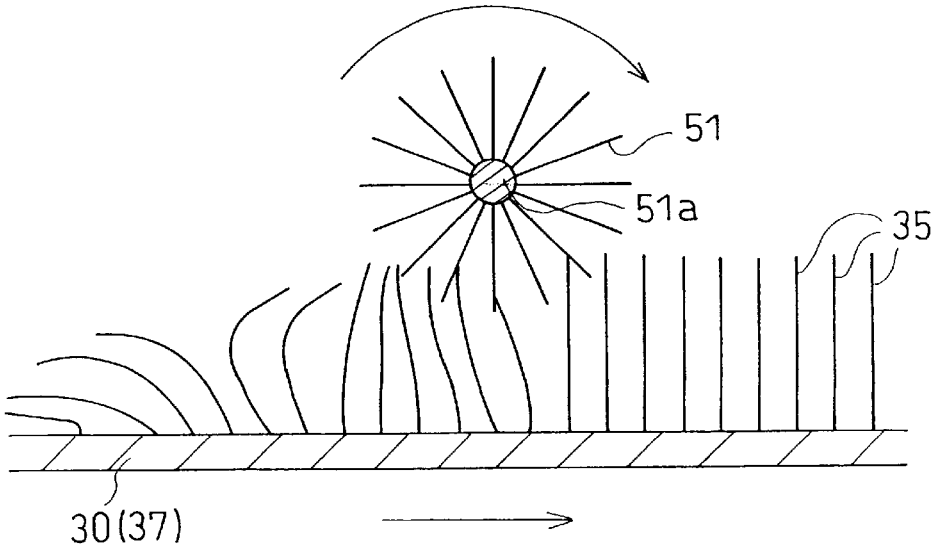
FIG. 15 is a schematic partial cross sectional view outlining a device used in a fiber erecting process.

As shown in FIG. 14, unlike the previously described embodiments, the fibers 35 of the seal member 30 are not inclined in the seal member 30 of the eighth embodiment. That is, the fibers 35 extend in radial directions of the roller 23.

Each fiber 35 is coated with a layer 50, which is surface treated with silicone for reducing the coefficient of friction. The silicone reduces the coefficient of friction on the surfaces of the fibers 35 and also wets the fibers 35. Therefore, the flexibility of the fibers 35 is improved. Other chemicals providing the same effect as that of the silicone, for example, include anionic surfactants, cationic surfactants, nonionic surfactants, amphoteric surfactants, silicone softening agents, urethane softening agents or polyester softening agents. The silicone softening agents are the most effective softening agents, so it is preferred to use the silicone softening agents for the surface treatment of the fibers 35.

Suitable examples of silicone softening agents include emulsion type softening agents such as dimethyl silicone, methyl hydrogen silicone, epoxy modified silicone, amino modified silicone or rubber silicone, and water soluble softening agents such as polyether modified silicone. Any one of these silicone softening agents may be selected. The coating layer 50 is formed by the roll coating process shown in FIG. 13.

A process for manufacturing the seal member 30 in accordance with the eighth embodiment will be described. Rayon fibers are attached to the surface of the substrate 37. After the attachment, each fiber 35 is coated with silicone softening agents by the roller 52 to form the coating layer 50. The fibers 35 are then erected by a brush 51.

The process for erecting the fibers 35 will now be described with reference to FIG. 15.

The brush 51 is attached to the outer circumferential surface of the rotating shaft 51*a*, so the brush 51 extends radially. The brush 51 is rotated in one direction (indicated by an arrow in FIG. 15) by the shaft 51*a*. The seal member 30 is arranged to engage with the brush 51 and moves in a direction opposite to the rotating direction of the brush 51. The brush 51 combs the fibers 35 of the seal member 30, so the fibers 35 are erected from the substrate 37.

When the seal member 30 of FIG. 14 is adhered to the inner surface of the housing 21, each fiber 35 is oriented in a radial direction of the small diameter portion 25. The erected fibers 35 are urged against the roller 23. As a result, a sliding contact between the seal member 30 and the roller 23 is enhanced to form a good seal.

In the seal member 30 of FIG. 14, the surfaces of the fibers 35 constituting the engaging layer 33 are coated for reducing the frictional resistance and increasing the flexibility of the fibers 35. Therefore, even though the fibers 35 of the seal member 30 are erected in the radial direction of the small diameter portion 23, the seal member 30 has a low coefficient of friction.

A ninth embodiment of the present invention will be described, focusing on differences between the ninth embodiment and the seventh embodiment (FIG. 12). The seal member of the ninth embodiment is not shown since it only differs from the seal member of the seventh embodiment shown in FIG. 12 in the material of the substrate 37.

The substrate 37 of the seal member 30 of the ninth embodiment is formed from woven fabric having the warp and the weft made of spun yarns in lieu of filament yarns. The weave type and the fiber density of the substrate 37 of the ninth embodiment are similar to those of the seventh embodiment.

A thickness of the spun yarn is normally indicated by a count. The count is converted into denier units in accordance with an equation, i.e., one denier=5315 divided by the count. In accordance with the present embodiment, white rayon fibers 300 deniers thick are used for the warp and white rayon fibers 450 deniers thick are used for the weft.

Spun yarn has higher elasticity relative to that of the filament yarn, so that the flexibility of the seal member 30 is improved. As a result, the seal member 30 may be adhered to the inner surface of the housing 21 without forming wrinkles, so that the leakage of the toner 16 is more effectively resisted.

A tenth embodiment of the present invention will now be described, focusing on differences between the tenth embodiment and the ninth embodiment.

The seal member 30 of the tenth embodiment is similar to that of the ninth embodiment except that filament yarns made of polyurethane fibers in lieu of the spun yarns made of the semi synthetic rayon fibers are used in at least one of the warp and weft of the substrate 37. The weave type and the fiber density of the substrate 37 are the same as those of the seventh embodiment (FIG. 12).

Filament yarns made of the polyurethane fibers are more flexible than spun yarns made of rayon fibers. If the more flexible filament yarns are used for the substrate 37, the seal member 30 will have more flexibility.

Furthermore, polyurethane adhesive is used for the first adhesive layer 32 in lieu of the acrylic adhesive. Polyurethane adhesive will strongly adhere to a substrate 37 formed of polyurethane fibers. Thus, the substrate 37 of the tenth embodiment is more flexible than that of the ninth embodiment, so the seal member 30 of the tenth embodiment can be firmly adhered to the inner surface of the housing 21.

In the seal member 30 of the tenth embodiment, polyurethane adhesive is used for the first adhesive layer 32, and the fibers 35 are made of, for example, rayon as disclosed in the seventh embodiment. As a result, the adhesive firmly adheres the fibers 35 to the substrate 37, so that depilation of the fibers 35 is substantially prevented.

An eleventh embodiment of the present invention will be described, focusing on differences between the eleventh embodiment and the seventh embodiment.

The substrate 37 of the seal member 30 in accordance with the eleventh embodiment includes a knit fabric unlike the substrate of the seventh embodiment. The knit fabric has more elasticity than the woven fabric, so the substrate 37 of the eleventh embodiment has improved elasticity.

Examples of stitches used for creating the knit fabric of the substrate 37 include the plain stitch, the chain stitch, the interlock stitch, the fleecy fabric and the Milano rib. In the eleventh embodiment, the substrate 37 is preferably produced by the plain stitch, which is the simplest stitch and which uses only one knitting yarn. Rayon fibers with a thickness of 300 deniers are used for the substrate 37 of the eleventh embodiment.

Since the substrate 37 of eleventh embodiment includes a knit fabric substrate 37, the elasticity of the seal member 30 is improved. Therefore, the seal member 30 can more reliably resist leakage of the toner 16.

The substrate 37 of the eleventh embodiment is formed with knit fabric of rayon fibers, and the manufacturing cost of the seal member 30 is thus reduced while the high flexibility of the seal member 30 is maintained.

The above described embodiments may be modified as follows.

In the first to eleventh embodiments, seal members 30 like those used in the developer 15 can also be used in the remover 19. More specifically, the seal member 30 may be arranged at both ends of the housing 19*a* of the remover 19 or both ends of the blade 19*b*, which constitute parts of the housing 19*a*. With this construction, leakage of the toner 16 from the developer 15 and the remover 19 is effectively resisted.

Figure 16:
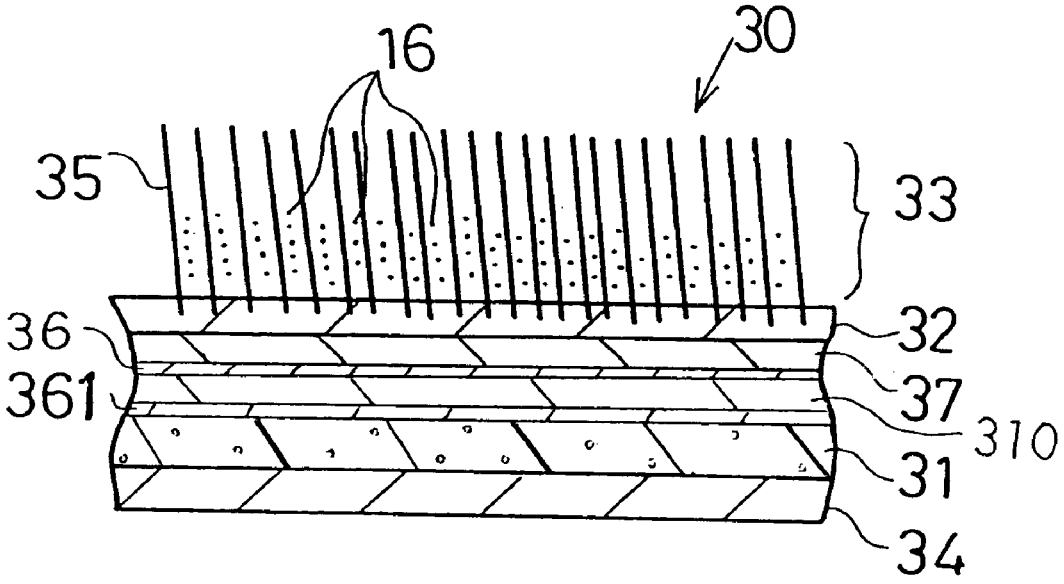
FIG. 16 is a schematic partial cross sectional view showing another example of the seal member according to the third embodiment.

The third embodiment can be modified as follows. As shown in FIG. 16, a heat shrinkable film 310 can be provided between the substrate 37 and the support layer 31, which is not heat shrinkable. The film 310 is adhered to the substrate 37 with the third adhesive layer 36 and is also adhered to the support layer 31 with a fourth adhesive layer 361. With this construction, the advantages similar to those of the third embodiment are achieved.

In the sixth embodiment shown in FIG. 11, instead of providing the support layer 31 having troughs 42 and the ridges 43, a support layer 31 without troughs 42 and the ridges 43 and a separate layer having the troughs 42 and the ridges 43 may be separately manufactured. Then, the separate layer is adhered to the support layer 31, wherein the fibers 35 may be attached to the surface of the separate layer. With this construction, although the manufacturing cost of the seal member 30 will be increased in comparison to the sixth embodiment, the attachment of the fibers 35 is more reliable. Depilation of the fibers 35 will thus be reduced.

In the first to eleventh embodiments, the seal member 30 may alternatively be adhered to the outer circumferential surface of the small diameter part 25 of the roller 23 or to the support shaft 22. With this construction, leakage of the toner 16 will be effectively limited as in the first to eleventh embodiments.

In the fourth to sixth embodiments shown in FIGS. 9 to 11, the substrate 37 may be arranged between the support layer 31 and the first adhesive layer 32. With this construction, while the advantages of the fourth to sixth embodiments are maintained, the attachment of the fibers 35 is more reliable, so that depilation of the fibers 35 is more effectively prevented.

In the first and fourth to eleventh embodiments, the support layer 31 may be made of heat shrinkable material like that of the third embodiment. With this construction, while the advantages of these embodiments are maintained, it is more unlikely that a gap will form between the seal member 30 and the inner surface of the housing 21.

In the first to fifth and seventh to eleventh embodiments, the engaging layer 33 may have a wave like inner contour produced by cutting the tips of the fibers 35 accordingly. Alternatively, like in the sixth embodiment, the wave like contour of the engaging layer 33 may be produced by shaping the surface of the support layer 31 into a wave like shape. With this construction, the toner attracting performance of the seal member 30 is enhanced.

In the fifth embodiment, two types of the fibers are irregularly mixed and implanted. However, the two types of fibers may be uniformly mixed and implanted. While this construction will result in a more complex manufacturing process, it should achieve a more uniform seal.

In the fourth embodiment shown in FIG. 9, the fibers 35 may be made of aramid fibers of different thicknesses and different rigidities or aramid fibers of the same thickness and different rigidities. While this construction will result in more complex manufacturing process, the toner 16 will be more reliably retained by the fibers 35.

In each embodiment described above, the fibers 35 may be oriented in the radial direction of the roller 23. Alternatively, as shown in FIG. 5, the fibers 35 may be inclined in a direction opposite to the rotating direction of the roller 23 (indicated by the two-dot chain line arrow). While this construction will create more resistance to the rotation of the roller 23, the toner 16 will be scraped away from the surface of the roller 23 more effectively. As a result, a seal member 30 having such a construction is advantageous when toner scraping (cleaning effect) is required in addition to the toner sealing.

In the seventh and eighth embodiments shown FIGS. 12 and 14, the substrate 37 may be eliminated. This construction can still provide the advantages of the seventh and eighth embodiments. Furthermore, the manufacturing cost of the seal member 30 will be reduced since the material cost of the substrate 37 is eliminated.

In the seventh and eighth embodiments, the fibers 35 may be made from a combination the thin and thick fibers, as in the fourth embodiment. In this construction, the thick fibers support the thin fibers, so the toner 16 is effectively retained around the bases of the fibers 35. As a result, the leakage of the toner 16 is substantially prevented.

In the seventh and eighth embodiments, the fibers 35 may be made from a combination of low-friction fibers and attractive fibers, which are capable of strongly attracting the toner. With this construction, the toner will be attracted to the attractive fibers. As a result, the seal member 30 will more effectively resist leakage of the toner 16.

In the ninth embodiment, spun yarn may be used for only one of the warp and weft. This construction will achieve flexibility as in the ninth embodiment and will reduce the manufacturing cost of the seal member 30.

In the eleventh embodiment, the fibers 35 may be made from fluororesin. In this instance, the surface treatment of the fibers 35 with fluororesin may be eliminated. With this construction, the friction produced by the seal member 30 is kept low and the flexibility of the seal member 30 is maintained, as in the eleventh embodiment.

In the first to seventh and ninth to eleventh embodiments, the fibers 35 may be surface treated with, for example, silicone softening agent. With this construction, the fibers 35 will have improved flexibility, and the friction of the seal member 30 will be reduced.

In the seventh to eleventh embodiments, although the coating layer 50 is formed on the entire surface of each fiber 35, the coating layer 50 may be formed only on a portion of the fiber surface. Alternatively, the low coefficient of friction of the fibers 35 may be achieved by impregnating chemicals within the fibers 35.

Therefore, the present examples and embodiments are to be considered as illustrative and not restrictive and the invention is not to be limited to the details given herein, but may be modified within the scope and equivalence of the appended claims.

What is claimed is:

1. A toner seal for sealing between a roller and a housing, the toner seal comprising:

a brush formed by a plurality of adjacent, linear, flexible fibers, all the fibers being substantially equal in thickness and length, and arranged to extend in substantially the same direction, wherein the brush forms a barrier against toner particles;

a flexible support for supporting the fibers, wherein the support is fixed to one of the housing and the roller, wherein the support layer is made from a foam material which has flexibility and elasticity and wherein the support layer has a first adhesive layer on one surface and a second adhesive layer on the other surface, wherein the fibers are implanted in the first adhesive layer by electrostatic flocking, and wherein the fibers are inclined relative to the support layer at an angle of at least about 5 degrees and at most about 70 degrees, and wherein the fibers contact the other of the roller and the housing to form the seal, wherein the roller is a rotating drum which rotates in a predetermined direction, and wherein the fibers are inclined toward the predetermined direction.

2. The seal according to claim 1, wherein the support has a circular shape when in use, and wherein each fiber is inclined with respect to a radius of the circular shape that intersects the base of the fiber.

3. The seal according to claim 2, wherein the distal ends of the fibers extend outwardly from the support and contact the roller, and the fibers are inclined toward a direction of rotation of the roller to minimize friction against the roller caused by the seal, and wherein an outer surface of the support is fixed to the housing.

4. A seal member arranged in a housing that accommodates fine particles used for printing images and a movable member for feeding the particles to a printing mechanism, wherein the seal member substantially prevents leakage of the particles from a clearance between the housing and the movable member, the seal member comprising:

fibers for capturing the particles, wherein all the fibers have substantially equal thickness and length, and each fiber has a thickness of 0.5 to 10 deniers and a length of 0.5 to 5 mm; and a support layer for supporting the fibers, wherein the support layer is made from a foam material which has flexibility and elasticity, and wherein the support layer has a first adhesive layer on one surface and a second adhesive layer on the other surface, wherein the fibers are implanted in the first adhesive layer by electrostatic flocking, and wherein the fibers are inclined relative to the support layer at an angle of at least about 5 degrees and at most about 70 degrees, wherein the movable member is a rotating drum, which rotates in a predetermined direction, and wherein the fibers are inclined toward the predetermined direction.

5. The seal member according to claim 4, wherein the fibers are made from a heat resistant material having low-friction surface characteristics and high durability.

6. The seal member according to claim 5, wherein the fibers are comprised of a combination of first and second fiber types, the first type having a different thickness than the second type.

7. The seal member according to claim 5, wherein the fibers are comprised of a combination of first and second fiber types, the first type having a different bending elasticity than the second type.

8. The seal member according to claim 5, wherein the tips of the fibers are contoured to form a wave-like shape.

9. The seal member according to claim 4, wherein the support layer is elastically compressible in a direction perpendicular to its surface.

10. The seal member according to claim 4, wherein the seal member is deformed to a circular shape when in use and the second adhesive layer is adhered to the housing or the moveable member.

11. The seal member according to claim 10, wherein the second adhesive layer is adhered to the housing.

12. The seal member according to claim 4, wherein the first and the second adhesive layers are flexible.

13. The seal member according to claim 4, wherein the fibers are comprised of a combination of low-friction fibers, which have a low-friction surface, and attractive fibers, which are capable of strongly attracting the particles.

14. The seal member according to claim 4, wherein the surfaces of the fibers are treated with a substance for reducing surface friction.

15. The seal member according to claim 4, wherein the second adhesive layer consists of an adhesive.

16. The seal member according to claim 15, wherein the second adhesive layer consists of a pressure sensitive adhesive.

17. A seal member arranged in a housing that accommodates fine particles used for printing images and a movable member for feeding the particles to a printing mechanism, wherein the seal member substantially prevents leakage of the particles from a clearance between the housing and the movable member, the seal member comprising:

fibers for capturing the particles, wherein all the fibers have substantially equal thickness and length and each fiber has a thickness of 0.5 to 10 deniers and a length of 0.5 to 5 mm; and a support layer for supporting the fibers, wherein the support layer is made from a foam material which has flexibility and elasticity, and wherein the support layer has a first adhesive layer on one surface and a second adhesive layer on the other surface, wherein the fibers are implanted in the first adhesive layer by electrostatic flocking, and wherein the fibers are inclined relative to the support layer at an angle of at least about 5 degrees and at most about 70 degrees, wherein the movable member in a rotating drum, which rotates in a predetermined direction, and wherein the fibers are inclined against the predetermined direction to scrape excess particles from surface of the movable member.

* * * * *

UNITED STATES PATENT AND TRADEMARK OFFICE

CERTIFICATE OF CORRECTION

PATENT NO. : 6,115,566
DATED : September 5, 2000
INVENTORS : Yasuyuki Ohara

It is certified that an error appears in the above-identified patent and that said Letters Patent are hereby corrected as shown below:

On the title page:

[30] Foreign Application Priority Data

| | | | |
|---|---|---|---|
| Aug. 20, 1997 | [JP] | Japan | 9-223826 |
| Mar. 13, 1998 | [JP] | Japan | 10-063083 |

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*